US006402992B1

(12) United States Patent
Kumar et al.

(10) Patent No.: US 6,402,992 B1
(45) Date of Patent: Jun. 11, 2002

(54) PROCESS FOR THE PREPARATION OF FLEXIBLE AND FREE STANDING CONDUCTING POLYANILINE FILM

(75) Inventors: Konda Kannan Satheesh Kumar; Geetha Sivasubramanian; Dinesh Chandra Trivedi, all of Karaikudi (IN)

(73) Assignee: Council of Scientific and Industrial Research, New Delhi (IN)

( * ) Notice: Subject to any disclaimer, the term of this patent is extended or adjusted under 35 U.S.C. 154(b) by 0 days.

(21) Appl. No.: 09/818,234

(22) Filed: Mar. 27, 2001

(51) Int. Cl.[7] ..... H01B 1/12
(52) U.S. Cl. ..... 252/500
(58) Field of Search ..... 252/500

(56) References Cited

U.S. PATENT DOCUMENTS 5,773,568 A * 6/1998 MacDiarmid et al. ..... 528/495

FOREIGN PATENT DOCUMENTS

WO WO-95/05404 * 2/1995

OTHER PUBLICATIONS

MacDiarmid et al, "Secondary Doping in Polyaniline", Synthetic Metals 69, (1995), pp. 85–92.*
MacDiarmid et al, "Secondary Doping: A new Concept . . . ", Macromol. Symp. 98, 835–842 (1995).*

* cited by examiner

*Primary Examiner*—Mark Kopec
(74) *Attorney, Agent, or Firm*—Ladas & Parry

(57) ABSTRACT

This invention relates to the preparation of free standing film of conducting polyaniline of varied thickness. The conducting polyaniline film is obtained by use of a functionalised aromatic sulphonic acid as primary dopant and a halosubstituted phenol as secondary dopant. The emeraldine base, primary dopant and secondary dopant are mixed in an appropriate amount and stirred. The resulted homogeneous thick viscous solution cast yields conducting polyaniline film of conductivity more than 10 S/cm.

6 Claims, 1 Drawing Sheet

Steps involved in chemical synthesis of polyaniline

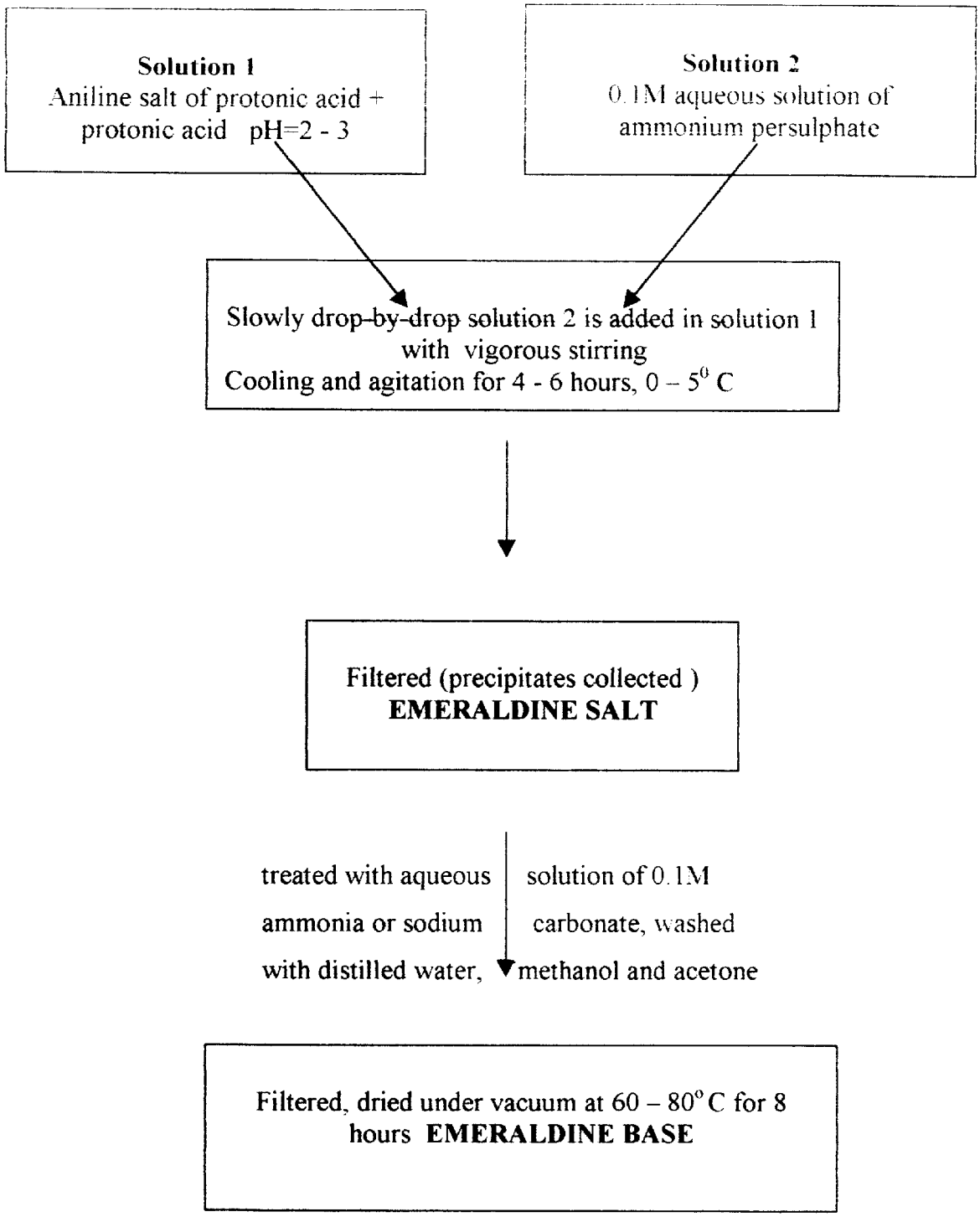
Steps involved in chemical synthesis of polyaniline

PROCESS FOR THE PREPARATION OF FLEXIBLE AND FREE STANDING CONDUCTING POLYANILINE FILM

FIELD OF THE INVENTION

The present invention relates to a process for the preparation of flexible and free standing conducting polyaniline film. The thickness of the film can be tailored

BACKGROUND OF THE INVENTION

Hitherto conducting polyaniline has been reported as a free standing conducting film having a electronic conductivity of 0.1 to 1 S/cm (Patent application—CSIR Ref. No. NF 290/00).

Film formation property is not observed when unfunctionalised dopants like hydrochloric acid, sulphuric acid, acetic acid and various other mineral and organic acids are used as primary dopants.

Copending patent application (C.S.I.R Ref NF 290/00) discloses a process to obtain the free standing conducting polyaniline ≈0.1 to 1 S/cm. The drawback of the process described in NF 290/00 is that the free standing film is obtained by casting polyaniline solution in organic solvents like chloroform, benzene, xylene and toluene which are difficult to recover. Also, the letting out of solvents in the atmosphere leads to pollution and secondly electronic conductivity lies in the range of 0.1 to 1 S/cm, which is not enough for many applications, Flexible and free standing conducting polymer film has application in the shielding of electromagnetic interference [EMI], conducting wires, as a thin film for batteries chemical sensor, anti-static agent, zebra connectors for multi-point connections and in many other electronic applications. It is therefore important to develop a process for the preparation of a flexible and free standing conducting polyaniline film.

OBJECTS OF THE INVENTION

The main object of the present invention is to provide an improved process for the preparation of flexible and free standing conducting polyaniline film around 10 S/cm and to avoid organic co-solvents to obviate the drawback as detailed above.

BRIEF DESCRIPTION OF THE ACCOMPANYING DRAWING

FIG. 1 is a flow chart of the process of the invention outlining the steps in the preparation of conducting polyaniline.

SUMMARY OF THE INVENTION

Accordingly the present invention relates to a process for the preparation of flexible and free standing conducting polyaniline film with electrical conductivity more than 10 S/cm, which comprises stirring an emeraldine base in the presence of a functionalised aromatic sulphonic acid as a primary dopant and a halo substituted phenol as a secondary dopant for 2–3 hours to obtain a homogeneous thick viscous solution, casting the said viscous solution on a suitable unreactive substrate and heating under vacuum at a temperature in the range of 50–70° C. for 10–24 hrs to obtain said flexible free standing polyaniline film.

In one embodiment of the invention, the functionalised aromatic sulphonic acid used comprises camphor-10-sulphonic acid.

In another embodiment of the invention, the halo substituted phenols used is selected from the group consisting of bromophenol, chlorophenol and flurophenol.

In yet another embodiment of the invention, the stirring is done by mechanical grinding.

In a further embodiment of the invention, the unreactive substrate is selected from the group consisting of polytetrafluoroethylene sheet, glass plate and mercury metal.

In yet another embodiment of the invention, the surface conductivity of 100% stetched conducting polyaniline film obtained is 100 S/cm.

Another embodiment of the present invention is by avoiding of co- solvent like chloroform, xylene, benzene and toluene.

DETAILED DESCRIPTION OF THE INVENTION

The conducting polyaniline of the invention is compatible with various type of engineering plastics. Electronic conductivity can be imparted to whole of the structure in an uniform manner to conventional plastics used for making cabinets to house electronic equipment and are transparent to electromagnetic radiations. Closely packed electronic circuitry requires the enclosures or housing to be electrically conductive for removal of static charge. The shielding of electromagnetic interference [EMI] is carried out by either using metallic frames or conductive components made by loading carbon black or metal powder or metal fiber which are susceptible for galvanic corrosion. Polyaniline prepared by the process herein finds application as a new material which is free from corrosion and brittleness.

In the present process the electronic conductivity of 10 S/cm is obtained on a free standing polyaniline film. The utilization of a conducting polyaniline is very difficult due to its intractable nature. That means it is neither soluble in any solvent nor has any softening point. Thus for its effective utilization processibility is still a great concern. Without wishing to be bound by any theory, it is believed that film formation property in polyaniline in presence of primary dopant and secondary dopant as given in example can uncoil the structure to an extended structure to yield a material, which has film formation property. This effect depends upon the ratio of emeraldine base, primary dopant and secondary dopant. This ratio is not constant and essentially is the function of an orientation, functionality and electronegativity of the primary dopant.

Emeraldine base form of polyaniline is prepared by the oxidative polymerisation of 0.1M aniline in 1M aqueous hydrochloric acid solution under vigorous stirring for a period of 4–6 hours at a temperature of 0–50° C. by adding drop by drop 0.1M aqueous solution of ammonium persulphate. At the end of the reaction acetone is added to terminate polymerisation reaction and the reaction mixture is filtered under suction and collected green precipitates of emeraldine hydrochloride are washed repeatedly with distilled water till these washings are colourless.

The filtered and washed precipitates are then treated with either aqueous solution of 0.1M sodium carbonate or ammonia under stirring for two hours for effective undoping reaction to obtain emeraldine base. This reaction mixture is filtered, washed with distilled water till washings are neutral to pH indicator paper. The collected blue precipitates are dried under dynamic vacuum at 60–80° C. for 8 hours. The detail process is depicted in FIG. 1.

The emeraldine base is a starting material for the preparation of our conducting polyaniline. This emeraldine base is dispersed in 0.1M aqueous solution of functionalised organic sulphonic acid under vigorous stirring for 4 hours to achieve 0.50 mole % doping. After 4 hours of a doping reaction, solution is filtered under suction and collected material is given washing with 0.1M aqueous solution of functionalised organic sulphonic acid. The so obtained polymer is dried at 50° C. under dynamic vacuum for 12 hours before use. The electronic conductivity of 2 ton pressed pellets of conducting protonic acid doped polyaniline by four-probe method at room temperature is given in Table 1.

TABLE 1

| Doping level of 0.50 per mole of repeat unit of polyaniline (two aniline molecule) | |
|---|---|
| Primary dopant | Conductivity (S/cm) |
| Camphor-10-sulphonic acid | 2.5 |

The details of the process are explained below:

In a beaker required amount of emeraldine base, functionalised organic sulphonic acid, halo substituted phenol are mixed by mechanical grinding for about 2 to 3 hrs, a solution obtained which cast on poly tetrafluroethylene, glass substrate or any un-reactive substrate yields a free standing and flexible dark green conducting polyaniline as film. The conductivity of the polyaniline film ≈10 S/cm is given in table 2

TABLE 2

| Conductivity of the film obtained by using functionalised organic sulphonic acid as primary dopant/halo substituted phenol as a secondary dopant. | | |
|---|---|---|
| Primary dopant | Secondary dopant | Conductivity (S/cm) |
| Camphor-10-sulphonic acid | Bromo phenol<br>Chloro phenol<br>Fluro phenol | 10 |

The following examples are given by way of illustration and therefore should not be construed to limit the scope of the present invention.

EXAMPLE—1

Preparation of Polyaniline Film by Using Functionalised Organic Sulphonic Acid as Primary Dopant/Halo Substituted Phenol as Secondary Dopant Under Dynamic Vacuum 1 mole emeraldine base was stirred with 0.5 mole of camphor 10-sulphonic acid and 2 moles of bromophenol for 2 hours. A homogeneous thick viscous liquid was obtain which was coated on a glass plate and was heated under dynamic vacuum at 50° C. for 20 hrs. The thickness of the film obtained was observed to be 0.1 mm and the conductivity 0.5 S/cm. The conductivity of the 100% stretched film was observed to be 30 S/cm.

EXAMPLE—2

Preparation of Polyaniline Film by Using Functionalised Organic Sulphonic Acid as Primary Dopant/Halo Substituted Phenol as Secondary Dopant Under Dynamic Vacuum 1 mole emeraldine base was stirred with 0.4 mole of camphor 10-sulphonic acid and 2.5 moles of chlorophenol for 2.5 hours. A homogeneous thick viscous liquid was obtained which was coated on a glass plate and was heated under dynamic vacuum at 60° C. for 20 hrs. The thickness of the film obtained was observed to be 0.5 mm and the conductivity 3 S/cm. The conductivity of the 100% stretched film was observed to be 30 S/cm.

EXAMPLE—3

Preparation of Polyaniline Film by Using Functionalised Organic Sulphonic Acid as Primary Dopant/Halo Substituted Phenol as Secondary Dopant Under Dynamic Vacuum 1 mole emeraldine base was stirred with 0.4 mole of camphor 10-sulphonic Acid and 3 moles of fluorohenol for 3 hours. A homogeneous thick viscous liquid was obtained which was coated on a glass plate and was heated under dynamic vacuum at 70° C. for 24 hrs. The thickness of the film obtained was observed to be 1 mm and the conductivity 10 S/cm. The conductivity of the 100% stretched film was observed to be 100 S/cm.

The main adventage of the present invention are:

1. The powdery intractable conducting polyaniline yields a material which Lives the free standing and flexible conducting polyaniline film.
2. Polyaniline obtained by this process can be mixed in all proportions in the host matrix of engineering plastics.
3. Polyaniline obtained by our method is soluble in common organic solvents such as benzene, toluene, chloroform, methanol, cyclohexanone and xylene.
4. The flexible conducting film is obtained without using any solvent.
5. Film can be stretched to 100%.
6. The Electronic conductivity of un-stretched film is more than 10 S/cm.
7. The conductivity of a stretched film is function of percentage of stretching.
8. The 100% stretched film has a conductivity of ≈100 S/cm.

We claim:

1. A process for the preparation of flexible and free standing conducting polyaniline film with electrical conductivity more than 10 S/cm, which comprises stirring an emeraldine base of polyaniline in the presence of a functionalized aromatic sulphonic acid as a primary dopant and a halo substituted phenol as a secondary dopant for 2–3 hours to obtain a homogeneous thick viscous solution, said solution being free of organic solvent; casting the viscous solution on a suitable unreactive substrate and heating under vacuum at a temperature in the range of 50–70° C. for 10–24 hours to obtain said flexible and free standing polyaniline film.

2. A process as claimed in claim 1, wherein the functionalized aromatic sulphonic acid comprises comphor-10-sulphonic acid.

3. A process as claimed in claim 1, wherein the halo substituted phenol is selected from the group consisting of bromophenol, chlorophenol, and fluorophenol.

4. A process as claimed in claim 1, wherein said stirring is a mechanical grinding.

5. A process as claimed in claim 1, wherein the unreactive substrate is selected from the group consisting of polytetrafluroroethylene sheet, glass plate and mercury metal.

6. A process as claimed in claim 1, wherein the conducting polyaniline film obtained has a surface conductivity when 100% stretched of 100 S/cm.

* * * * *